US012680544B2

(12) United States Patent
Davies et al.

(10) Patent No.: US 12,680,544 B2
(45) Date of Patent: Jul. 14, 2026

(54) SEAL ASSEMBLY FOR PROGRESSIVE CAVITY PUMP

(71) Applicant: NATIONAL OILWELL VARCO, L.P., Houston, TX (US)

(72) Inventors: Michael Davies, Stockport (GB); Chris Griffiths, Northwich (GB)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 0 days.

(21) Appl. No.: 18/679,911

(22) Filed: May 31, 2024

(65) Prior Publication Data

US 2025/0369442 A1 Dec. 4, 2025

(51) Int. Cl.
*F04C 15/00* (2006.01)
*F04C 2/10* (2006.01)

(52) U.S. Cl.
CPC ..... *F04C 15/0003* (2013.01); *F04C 2/10* (2013.01); *F04C 15/0038* (2013.01); *F04C 15/0073* (2013.01); *F04C 2230/70* (2013.01)

(58) Field of Classification Search
CPC ..... F04C 15/0003; F04C 2/10; F04C 2230/07
See application file for complete search history.

(56) References Cited

U.S. PATENT DOCUMENTS

| | | | |
|---|---|---|---|
| 435,325 | A | 8/1890 | Schneider |
| 1,201,863 | A | 10/1916 | Orey |
| 1,806,687 | A | 5/1931 | Hoover |
| 2,545,604 | A | 3/1951 | Cameron |
| 2,612,845 | A | 10/1952 | Cameron et al. |
| 3,011,445 | A | 12/1961 | David |
| 4,127,368 | A | 11/1978 | Langer |
| 4,558,954 | A | 12/1985 | Barr |
| 4,863,359 | A | 9/1989 | Unterstrasser et al. |
| 5,139,400 | A | 8/1992 | Ide |
| 5,318,416 | A | 6/1994 | Hantschk et al. |
| 5,620,313 | A | 4/1997 | Fockenberg |
| 5,769,618 | A | 6/1998 | Ono et al. |

(Continued)

FOREIGN PATENT DOCUMENTS

| | | |
|---|---|---|
| AU | 2007221859 | 4/2009 |
| AU | 2015357838 | 7/2017 |

(Continued)

OTHER PUBLICATIONS

Translation WO-2019154571-A1 (Year: 2025).*

(Continued)

*Primary Examiner* — J. T. Newton
(74) *Attorney, Agent, or Firm* — Schwegman Lundberg & Woessner, P.A.

(57) ABSTRACT

A seal assembly for sealing a power input shaft of a progressive cavity pump can include a seal housing arranged around the power input shaft, the seal housing can include a mounted portion, mounted to the progressive cavity pump, a removable portion, removably coupled to the mounted portion, which can be configured to apply a compression force to a seal within the seal assembly, and a sealing element, which can be configured to seal an interface between the mounted portion and the removable portion. The seal housing can be configured so that a portion of the mounted portion can be in direct contact with a portion of the removable portion.

19 Claims, 7 Drawing Sheets

(56) References Cited

U.S. PATENT DOCUMENTS

| | | | |
|---|---|---|---|
| 5,807,087 | A | 9/1998 | Brandt et al. |
| 5,924,929 | A | 7/1999 | Silver |
| 6,155,807 | A | 12/2000 | Fenton |
| 6,162,032 | A | 12/2000 | Jager |
| 7,040,878 | B2 | 5/2006 | Denk et al. |
| 7,104,770 | B2 | 9/2006 | Bauer et al. |
| 7,137,795 | B2 | 11/2006 | Kamal et al. |
| 7,465,157 | B2 | 12/2008 | Weber |
| 7,473,082 | B2 | 1/2009 | Marielle |
| 7,517,202 | B2 | 4/2009 | Delpassand |
| 7,556,214 | B2 | 7/2009 | Parrett et al. |
| 7,618,246 | B2 | 11/2009 | Frisch et al. |
| 8,007,259 | B2 | 8/2011 | Kreidl et al. |
| 8,033,802 | B2 | 10/2011 | Tekneyan et al. |
| 8,215,014 | B2 | 7/2012 | Amburgey |
| 8,257,633 | B2 | 9/2012 | Sindt et al. |
| 8,439,659 | B2 | 5/2013 | Loeker et al. |
| 8,764,420 | B2 | 7/2014 | Overmeier et al. |
| 8,967,948 | B2 | 3/2015 | Hashima et al. |
| 9,517,871 | B2 | 12/2016 | Enko et al. |
| 9,670,779 | B2 | 6/2017 | Heizinger et al. |
| 9,683,566 | B2 | 6/2017 | Bindig et al. |
| 9,719,506 | B2 | 8/2017 | Kamal et al. |
| 10,113,426 | B2 | 10/2018 | Eisner |
| 10,161,397 | B2 | 12/2018 | Dicks et al. |
| 10,208,576 | B2 | 2/2019 | Heizinger et al. |
| 10,563,651 | B2 | 2/2020 | Kreidl et al. |
| 10,648,337 | B2 | 5/2020 | Overmeier et al. |
| 10,717,612 | B2 | 7/2020 | Rickers et al. |
| 10,760,570 | B2 | 9/2020 | Voit et al. |
| 10,760,571 | B2 | 9/2020 | Tekneyan et al. |
| 10,767,646 | B2 | 9/2020 | Tekneyan et al. |
| 11,236,747 | B2 | 2/2022 | Hauck et al. |
| 11,286,928 | B2 | 3/2022 | Krampe et al. |
| 11,326,594 | B2 | 5/2022 | Garnier et al. |
| 11,326,595 | B2 | 5/2022 | Overmeier |
| 11,378,078 | B2 | 7/2022 | Dicks et al. |
| 11,391,280 | B2 | 7/2022 | Wecking et al. |
| 11,441,560 | B2 | 9/2022 | Dicks et al. |
| 11,841,017 | B2 | 12/2023 | Harking |
| 11,916,454 | B2 | 2/2024 | Kawamoto et al. |
| 11,920,637 | B2 | 3/2024 | Linder et al. |
| 12,152,588 | B1 | 11/2024 | Kenny et al. |
| 2002/0168222 | A1 | 11/2002 | Simons et al. |
| 2005/0079083 | A1 | 4/2005 | Lievestro et al. |
| 2008/0008611 | A1 | 1/2008 | Kreidl et al. |
| 2009/0074599 | A1 | 3/2009 | Tekneyan et al. |
| 2009/0081050 | A1 | 3/2009 | Moore et al. |
| 2009/0110579 | A1 | 4/2009 | Amburgey |
| 2010/0196182 | A1 | 8/2010 | Loeker et al. |
| 2010/0243233 | A1* | 9/2010 | Salloum ..... E21B 33/085 166/84.1 |
| 2011/0020160 | A1 | 1/2011 | Wautelet et al. |
| 2011/0123380 | A1 | 5/2011 | Thomas et al. |
| 2012/0063941 | A1 | 3/2012 | Overmeier et al. |
| 2014/0016991 | A1 | 1/2014 | Kamal et al. |
| 2014/0360970 | A1 | 12/2014 | Chen |
| 2015/0010342 | A1 | 1/2015 | Groth et al. |
| 2015/0086350 | A1 | 3/2015 | Kamal et al. |
| 2015/0285245 | A1 | 10/2015 | Weber |
| 2016/0084085 | A1 | 3/2016 | Eisner |
| 2016/0341197 | A1 | 11/2016 | Tanaka |
| 2018/0180044 | A1 | 6/2018 | Tekneyan et al. |
| 2018/0372092 | A1 | 12/2018 | Rothschild et al. |
| 2019/0162183 | A1 | 5/2019 | Krampe |
| 2019/0257308 | A1 | 8/2019 | Overmeier |
| 2019/0316583 | A1 | 10/2019 | Dicks et al. |
| 2020/0056609 | A1 | 2/2020 | Hauck et al. |
| 2020/0080554 | A1 | 3/2020 | Hashima |
| 2020/0256334 | A1 | 8/2020 | Wecking et al. |
| 2020/0284262 | A1 | 9/2020 | Coghlan |
| 2021/0140428 | A1 | 5/2021 | Dicks et al. |
| 2023/0167818 | A1 | 6/2023 | Rolfes et al. |
| 2023/0175554 | A1 | 6/2023 | Salomonsson |
| 2023/0265847 | A1 | 8/2023 | Goetz et al. |
| 2024/0392779 | A1 | 11/2024 | Kenny et al. |
| 2024/0392783 | A1 | 11/2024 | Kenny et al. |
| 2025/0369439 | A1 | 12/2025 | Nesbitt et al. |
| 2025/0369470 | A1 | 12/2025 | Davies |

FOREIGN PATENT DOCUMENTS

| | | |
|---|---|---|
| AU | 2015311228 | 6/2019 |
| AU | 2017358848 | 1/2022 |
| BR | PI0815403 | 2/2015 |
| CA | 2264361 | 9/1999 |
| CA | 2167545 | 10/2000 |
| CA | 2387833 | 4/2001 |
| CA | 2609025 | 4/2009 |
| CA | 2609110 | 4/2009 |
| CA | 2959443 | 3/2016 |
| CN | 1162622 | 8/2004 |
| CN | 101796301 | 5/2013 |
| CN | 102400909 | 3/2016 |
| CN | 106605067 | 11/2018 |
| CN | 107002668 | 2/2019 |
| CN | 106605066 | 6/2019 |
| CN | 109952436 | 3/2021 |
| CN | 109952435 | 4/2021 |
| CN | 110271866 | 6/2021 |
| CN | 115552137 | 12/2022 |
| DE | 2118759 | 11/1972 |
| DE | 8816209 | 2/1989 |
| DE | 8817238 | 1/1995 |
| DE | 19501441 | 4/1996 |
| DE | 29520850 | 4/1996 |
| DE | 3833515 | 7/1996 |
| DE | 29812846 | 10/1998 |
| DE | 19813999 | 11/1999 |
| DE | 20011301 | 10/2000 |
| DE | 19842754 | 4/2001 |
| DE | 10118071 | 5/2003 |
| DE | 10116641 | 7/2003 |
| DE | 202005008989 | 8/2005 |
| DE | 102006058166 | 6/2008 |
| DE | 102008021920 | 2/2009 |
| DE | 102008021919 | 11/2009 |
| DE | 102009015024 | 7/2010 |
| DE | 202013004219 | 5/2013 |
| DE | 102010037440 | 11/2014 |
| DE | 102014116327 | 5/2016 |
| DE | 102014112550 | 6/2016 |
| DE | 102014112552 | 6/2016 |
| DE | 202016008445 | 1/2018 |
| DE | 202018101651 | 4/2018 |
| DE | 102016121582 | 5/2018 |
| DE | 102016121581 | 7/2018 |
| DE | 102017100540 | 9/2018 |
| DE | 102017104768 | 9/2018 |
| DE | 102016117910 | 10/2018 |
| DE | 102017007507 | 2/2019 |
| DE | 102017126002 | 2/2019 |
| DE | 102018102640 | 8/2019 |
| DE | 102018106228 | 9/2019 |
| DE | 102018110917 | 11/2019 |
| DE | 102018113347 | 12/2019 |
| DE | 102018117374 | 1/2020 |
| DE | 102019107671 | 7/2020 |
| DE | 102019005366 | 2/2021 |
| DE | 102019123180 | 3/2021 |
| DE | 202019107043 | 3/2021 |
| DE | 102019107078 | 4/2021 |
| DE | 102019126675 | 4/2021 |
| DE | 102019130981 | 5/2021 |
| DE | 102019135635 | 6/2021 |
| DE | 102019005367 | 1/2023 |
| DE | 102022108814 | 10/2023 |
| EP | 0723081 | 2/1999 |
| EP | 0935072 | 8/1999 |
| EP | 0994256 | 4/2000 |
| EP | 1227243 | 7/2002 |
| EP | 0947700 | 1/2004 |
| EP | 1739307 | 1/2007 |
| EP | 1418336 | 10/2007 |

(56) References Cited

FOREIGN PATENT DOCUMENTS

| | | | |
|---|---|---|---|
| EP | 2205872 | 7/2010 | |
| EP | 2176552 | 5/2012 | |
| EP | 2610493 | 7/2013 | |
| EP | 3096014 | 11/2016 | |
| EP | 2428680 | 7/2017 | |
| EP | 3189235 | 2/2019 | |
| EP | 3473856 | 4/2019 | |
| EP | 3189237 | 9/2019 | |
| EP | 3538766 | 9/2019 | |
| EP | 3538767 | 9/2019 | |
| EP | 3539911 | 9/2019 | |
| EP | 3749861 | 12/2020 | |
| EP | 3803122 | 4/2021 | |
| EP | 3824162 | 5/2021 | |
| EP | 4282539 | 11/2023 | |
| FR | 2823536 | 10/2005 | |
| FR | 3023327 | 1/2016 | |
| GB | 2377255 | 8/2004 | |
| GB | 2556425 | 3/2021 | |
| HK | 1144457 | 2/2011 | |
| JP | S4960424 | 5/1974 | |
| JP | H08319939 | 12/1996 | |
| JP | H11311187 | 11/1999 | |
| JP | 2010537095 | 12/2010 | |
| JP | 5917216 | 4/2016 | |
| JP | 2019156642 | 9/2019 | |
| JP | 6660942 | 2/2020 | |
| KR | 102190348 | 12/2020 | |
| KR | 20240128691 | 8/2024 | |
| WO | 0129423 | 4/2001 | |
| WO | 2009024279 | 2/2009 | |
| WO | 2011146245 | 11/2011 | |
| WO | 2012090968 | 7/2012 | |
| WO | 2014111082 | 7/2014 | |
| WO | 2014150917 | 9/2014 | |
| WO | 2016034340 | 3/2016 | |
| WO | 2016034341 | 3/2016 | |
| WO | 2016198036 | 12/2016 | |
| WO | 2018019318 | 2/2018 | |
| WO | 2018087248 | 5/2018 | |
| WO | 2018087254 | 5/2018 | |
| WO | 2018130463 | 7/2018 | |
| WO | 2018162360 | 9/2018 | |
| WO | 2019078903 | 4/2019 | |
| WO | 2019091701 | 5/2019 | |
| WO | 2019154571 | 8/2019 | |
| WO | WO-2019154571 A1 * | 8/2019 | ..... F04C 15/0073 |
| WO | 2019233859 | 12/2019 | |
| WO | 2020015873 | 1/2020 | |
| WO | 2021037668 | 3/2021 | |
| WO | 2021094087 | 5/2021 | |
| WO | 2021121743 | 6/2021 | |
| WO | 2024249197 | 12/2024 | |
| WO | 2024249198 | 12/2024 | |
| WO | 2025250345 | 12/2025 | |
| WO | 2025250346 | 12/2025 | |
| WO | 2025250359 | 12/2025 | |

OTHER PUBLICATIONS

"U.S. Appl. No. 18/324,659, Non Final Office Action mailed Sep. 12, 2023", 13 pgs.
"DE 202013004219 U1 English Version", 8 pgs.
"WO2012090968 A1 English Version", 13 pgs.
"U.S. Appl. No. 18/324,659, Response filed Nov. 10, 2023 to Non Final Office Action mailed Sep. 12, 2023", 12 pgs.
"U.S. Appl. No. 18/324,659, Final Office Action mailed Feb. 7, 2024", 10 pgs.
"Pulp and Paper Making Hollow Rotor of Progressing Cavity Pump", [Online]. Retrieved from the Internet: URL: https: hbronice. en.made-in-china.com product yOlAeUuCCGqx China-Pulp-and-Paper-Making-Hollow-Rotor-of-Progressing-Cavity-Pump.html, (accessed on Mar. 15, 2024), 11 pgs.
"MSPC-1"-20MM-F", [Online]. Retrieved from the Internet: URL: https: www.ruland.com mspc-1-20mm-f.html, (Accessed on Mar. 15, 2024), 5 pgs.
"U.S. Appl. No. 18/324,659, Response filed Mar. 15, 2024 to Final Office Action mailed Feb. 7, 2024", 11 pgs.
"Improved Productivity SCT Smart Conveying Technology", [Online]. Retrieved from the Internet: URL: https: www.seepex. com en-us products pumps sct-smart-conveying-technology, (accessed on Mar. 22, 2024), 17 pgs.
"Standard Gland Backplate Mech Seals to DIN 24960", (1983), 1 pg.
"U.S. Appl. No. 18/324,659, Final Office Action mailed Apr. 1, 2024", 8 pgs.
"U.S. Appl. No. 18/324,645, Non Final Office Action mailed Apr. 2, 2024", 16 pgs.
"Seal", (1983), 1 pg.
"Maintenance Manual", Leaflet 8101, (Apr. 1985), 1 pg.
"U.S. Appl. No. 18/324,659, Response filed Jun. 3, 2024 to Final Office Action mailed Apr. 1, 2024", 10 pgs.
"U.S. Appl. No. 18/324,645, Response filed Jun. 19, 2024 to Non Final Office Action mailed Apr. 2, 2024", 13 pgs.
"U.S. Appl. No. 18/680,394, Preliminary Amendment Filed Jun. 5, 2024", 5 pgs.
"U.S. Appl. No. 18/324,659, Notice of Allowance mailed Jul. 3, 2024", 9 pgs.
"English translation of WO 0219423 by PE2E", 7 pgs.
"International Application Serial No. PCT US2024 030486, International Search Report mailed Sep. 4, 2024", 4 pgs.
"International Application Serial No. PCT US2024 030486, Written Opinion mailed Sep. 4, 2024", 5 pgs.
"U.S. Appl. No. 18/324,659, Notice of Allowance mailed Sep. 6, 2024", 8 pgs.
"International Application Serial No. PCT US2024 030489, Invitation to Pay Additional Fees mailed Sep. 17, 2024", 5 pgs.
"U.S. Appl. No. 18/680,394, Restriction Requirement mailed Oct. 22, 2024", 7 pgs.
"U.S. Appl. No. 18/324,645, Non Final Office Action mailed Oct. 31, 2024", 11 pgs.
"International Application Serial No. PCT US2024 030489, International Search Report mailed Nov. 8, 2024", 6 pgs.
"International Application Serial No. PCT US2024 030489, Written Opinion mailed Nov. 8, 2024", 9 pgs.
"U.S. Appl. No. 18/680,394, Response filed Dec. 13, 2024 to Restriction Requirement mailed Oct. 22, 2024", 6 pgs.
"IFD-Stator 2.0 for NEMO Progressing Cavity Pumps", [Online]. Retrieved from the Internet: URL: https: pumps-systems.netzsch. com en products-and-accessories accessories-optional-equipment i-fd-stator-2-0-for-nemo-progressing-cavity-pumps, (Accessed on Dec. 26, 2024), 12 pgs.
"SCT—Smart Conveying Technology Product Line", [Online]. Retrieved from the Internet: URL: https: www.seepex.com en-us products pumps sct-smart-conveying-technology, (accessed on Dec. 26, 2024), 9 pgs.
"U.S. Appl. No. 18/324,645, Response filed Jan. 24, 2025 to Non Final Office Action mailed Oct. 31, 2024", 14 pgs.
"U.S. Appl. No. 18/324,645, Final Office Action mailed Apr. 29, 2025", 15 pgs.
"U.S. Appl. No. 18/680,394, Response filed Apr. 29, 2025 to Non Final Office Action mailed Jan. 29, 2025", 11 pgs.
"U.S. Appl. No. 18/324,645, Response filed Jun. 19, 2025 to Final Office Action mailed Apr. 29, 2025", 13 pgs.
"U.S. Appl. No. 18/324,645, Advisory Action mailed Jul. 31, 2025", 3 pgs.
"International Application Serial No. PCT US2024 030486, International Preliminary Report on Patentability mailed Aug. 14, 2025", 8 pgs.
"International Application Serial No. PCT US2024 030489, International Preliminary Report on Patentability mailed Aug. 14, 2025", 5 pgs.
"International Application Serial No. PCT US2024 030489, Response to Written Opinion filed Mar. 20, 2025 to Written Opinion mailed Nov. 8, 2024", 9 pgs.

(56) References Cited

OTHER PUBLICATIONS

"International Application Serial No. PCT US2024 030486, Response to Written Opinion filed Mar. 20, 2025 to Written Opinion mailed Sep. 4, 2024", 13 pgs.
"International Application Serial No. PCT US2025 029300, International Search Report mailed Aug. 25, 2025", 3 pgs.
"International Application Serial No. PCT US2025 029300, Written Opinion mailed Aug. 25, 2025", 5 pgs.
"International Application Serial No. PCT US2025 029075, International Search Report mailed Aug. 27, 2025", 3 pgs.
"International Application Serial No. PCT US2025 029075, Written Opinion mailed Aug. 27, 2025", 8 pgs.
"International Application Serial No. PCT US2025 029080, International Search Report mailed Sep. 2, 2025", 4 pgs.
"International Application Serial No. PCT US2025 029080, Written Opinion mailed Sep. 2, 2025", 8 pgs.
"U.S. Appl. No. 18/324,645, Examiner Interview Summary mailed Sep. 12, 2025", 4 pgs.
"U.S. Appl. No. 18/680,394, Non Final Office Action mailed Jan. 29, 2025", 15 pgs.
"U.S. Appl. No. 18/680,394, Non Final Office Action mailed Nov. 12, 2025", 8 pgs.
"U.S. Appl. No. 18/324,645, Non Final Office Action mailed Dec. 17, 2025", 9 pgs.
"International Application Serial No. PCT US2025 048034, International Search Report mailed Jan. 30, 2026", 4 pgs.
"International Application Serial No. PCT US2025 048034, Written Opinion mailed Jan. 30, 2026", 9 pgs.
"U.S. Appl. No. 18/680,394, Response filed Feb. 11, 2026 to Non Final Office Action mailed Nov. 12, 2025", 9 pgs.
"U.S. Appl. No. 18/324,645, Examiner Interview Summary mailed Feb. 26, 2026", 3 pgs.
"U.S. Appl. No. 18/324,645, Response filed Mar. 17, 2026 to Non Final Office Action mailed Dec. 17, 2025", 17 pgs.

* cited by examiner

SEAL ASSEMBLY FOR PROGRESSIVE CAVITY PUMP

CROSS-REFERENCE TO RELATED PATENT DOCUMENTS

This patent application is related to Davies, U.S. patent application Ser. No. 18/679,901 entitled "Split Shaft Coupling," filed on the same date as the present application, which is hereby incorporated by reference herein in its entirety.

TECHNICAL FIELD

The present disclosure relates to seals, and more particularly, but not by way of limitation, to shaft seals.

BACKGROUND

The background description provided herein is intended to generally present the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

A progressive cavity pump can be a positive displacement pump and may also be referred to as a progg cavity pump, an eccentric screw pump, or a cavity pump. Progressive cavity pumps may include a stator with a helically shaped cavity and a helically shaped rotor arranged in the cavity of the stator. The rotor may be rotated in the stator, which may cause the transfer of fluids through a sequence of progressing cavities, which can be formed between the stator and rotor. The rotor may be driven by a power input shaft that crosses a boundary of a pump chamber where liquid or flowable material is present.

A shaft seal can be used to seal around the power input shaft where it enters the pump chamber. This seal can be configured to prevent or limit fluid flow along the shaft. As such, the shaft seal can be configured to prevent or limit fluid from a pump chamber of a progressive cavity pump from escaping the pump chamber around a power input shaft.

SUMMARY

In an example, a seal assembly for sealing a power input shaft of a progressive cavity pump can include a seal housing arranged around the power input shaft, the seal housing can include a mounted portion, mounted to the progressive cavity pump, a removable portion, removably coupled to the mounted portion, which can be configured to apply a compression force to a seal within the seal assembly, and a sealing element, which can be configured to seal an interface between the mounted portion and the removable portion. Where the seal housing can be configured so that a portion of the mounted portion can be in direct contact with a portion of the removable portion.

In an example, a method of replacing one or more components of a seal in a seal assembly for sealing a power input shaft of a progressive cavity pump can include decoupling the power input shaft from a prime mover shaft. The method can also include decoupling a removable portion of the seal assembly from a mounted portion of the seal assembly, where the mounted portion can be mounted to the progressive cavity pump, where the removable portion can be configured to apply a compression force to the seal within the seal assembly. The method can also include removing one or more components of the seal from the power input shaft through a gap between the power input shaft and the prime mover shaft.

In an example, a progressive cavity pump system can include a prime mover including a prime mover shaft. The progressive cavity pump system can also include a progressive cavity pump, including a power input shaft. The progressive cavity pump system can also include a seal assembly for sealing the power input shaft of a progressive cavity pump, the seal assembly can include a seal housing arranged around the power input shaft, the seal housing including a mounted portion, mounted to the progressive cavity pump, a removable portion, removably coupled to the mounted portion, which can be configured to apply a compression force to a seal within the seal assembly, and a sealing element, which can be configured to seal an interface between the mounted portion and the removable portion. The seal housing can be configured so that a portion of the mounted portion can be in direct contact with a portion of the removable portion.

BRIEF DESCRIPTION OF THE DRAWINGS

In the drawings, which may not be drawn to scale, like numerals may describe substantially similar components throughout one or more of the views. Like numerals having different letter suffixes may represent different instances of substantially similar components. The drawings illustrate generally, by way of example but not by way of limitation.

DETAILED DESCRIPTION

A progressive cavity pump system can include one or more seal assemblies (e.g., a seal), which can include one or more shaft seals. A shaft seal can be placed around the power input shaft of the progressive cavity pump. The power input shaft can pass from a pump chamber (e.g., the intake chamber) to an area external to the pump chamber (e.g., another pump chamber, an ambient location).

A shaft seal assembly can include a two-portion housing, which can allow the housing to be split, which can provide access to seal components (e.g., wear components, such as the static or dynamic faces). In an approach, a sealing element can be placed between the two portions, which can act to prevent or limit a fluid from escaping between the two portions. However, the sealing element can be configured to be compressible (e.g., a rubber). This can result in the sealing element providing a degree of movement (e.g., free play, backlash) between the two portions. This can affect one or more of the alignment of the two portions, a compression force applied to the seal element, or a compression force applied to a seal within the housing.

A shaft seal assembly can include one or more regions of direct contact between the two portions of the housing (e.g., the material of the first portion touches the material of the second portion without any intervening components). This region of direct contact can help to provide one or more of a particular level of compression on the sealing element between the two portions, a particular level of compression on the seal, a particular longitudinal position (e.g., alignment or position along an axis, such as a center axis) of the portions, or a particular axial alignment (e.g., alignment of two axis, such as two center axis) of the two portions. A shaft seal can also include one or more radial alignment features, which can help to radially align the two portions.

Figure 1:
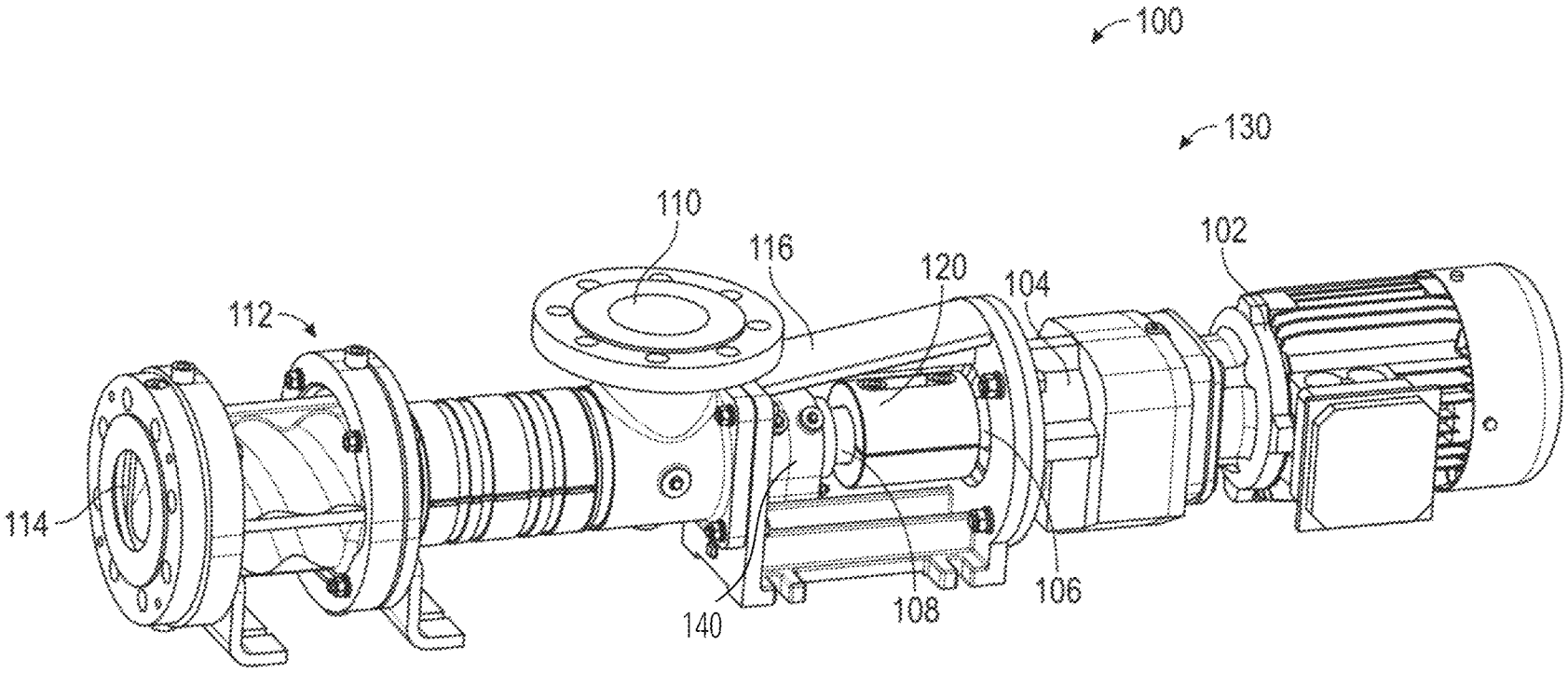
FIG. 1 shows a perspective view of an example of portions of a progressive cavity pump system.
Figure 2:
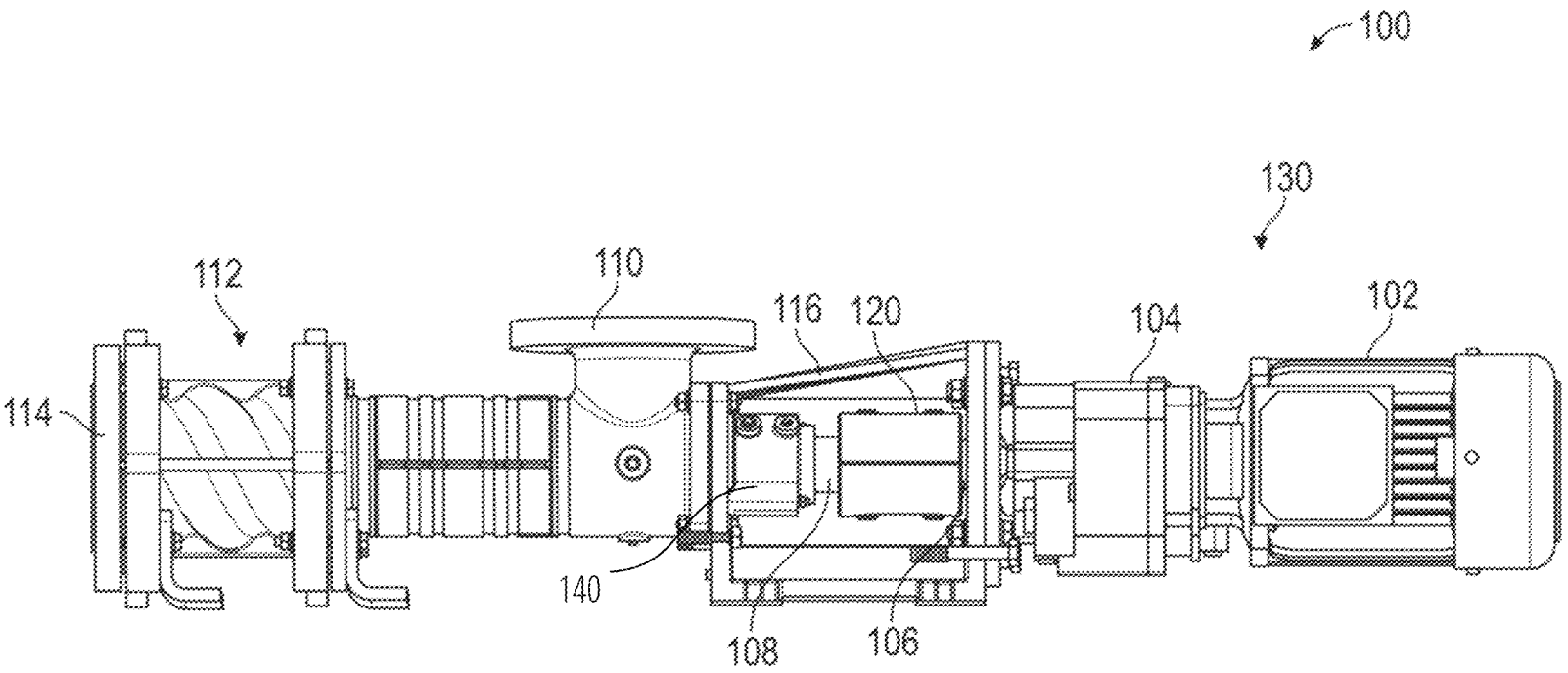
FIG. 2 shows a side view of the progressive cavity pump system of FIG. 1.
Figure 3:
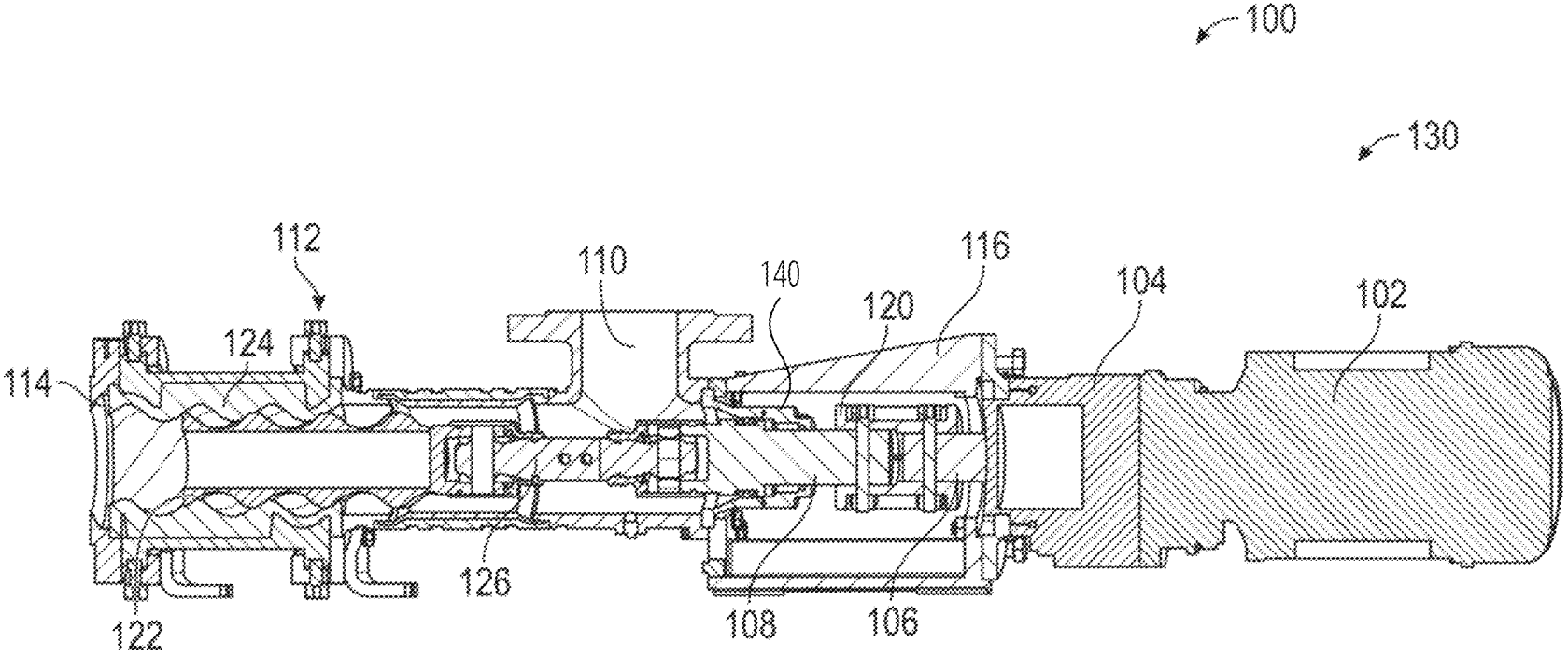
FIG. 3 shows a cross-sectional view of the progressive cavity pump system of FIG. 1.

FIG. 1 through FIG. 3 show an example of portions of a progressive cavity pump system 100, and will be discussed together below. FIG. 1 shows a perspective view of an example of portions of a progressive cavity pump system 100. FIG. 2 shows a side view of the progressive cavity pump system 100 of FIG. 1. FIG. 3 shows a cross-sectional view of the progressive cavity pump system 100 of FIG. 1, where the cross section splits the progressive cavity pump system 100 vertically along a longitudinal axis. The progressive cavity pump system may be configured to pump fluids, slurries, sludges, or other flowable material. The progressive cavity pump system 100 can include a prime mover 130, a progressive cavity pump 112, a seal assembly 140, a shaft coupling 120, and a housing 116.

The prime mover 130 can be configured to provide a motive force on the prime mover shaft 106, which can in turn provide a motive force to the progressive cavity pump 112 (e.g., through the shaft coupling 120). The prime mover 130 can include a motor 102 and a gearbox 104. The motor 102 can be coupled to the gearbox 104. The motor 102 can include an electric motor configured to generate rotational output power (e.g., torque) in a motor shaft from input electrical power. In an example, the motor 102 can be any form of power source, such as an electric motor, a combustion engine, a turbine engine, a hydraulic pump, etc. In an example, the prime mover 130 can include any device or system capable of providing a motive force to the progressive cavity pump 112, which can optionally include a gearbox 104 in addition to the motor 102.

The gearbox 104 can include a gearbox input shaft, which can be coupled to the motor shaft. The gearbox 104 can also include the prime mover shaft 106, which can be the output shaft of the gearbox 104. The gearbox 104 can change an angular velocity between the input shaft and the output shaft, change a mechanical advantage between the input shaft and the output shaft, or both. In an example, the gearbox 104 can decrease a rotational speed and increase a mechanical advantage between the input shaft and the output shaft.

With continued reference to FIGS. 1-3, the progressive cavity pump 112 of the system 100 may be described. The progressive cavity pump 112 may be configured to receive rotational power from the prime mover shaft 106 and pump and/or pressurize a flowable material using the rotational power operatively coupled to a positive displacement mechanism. More particularly, the progressive cavity pump 112 can include a fluid inlet 110, a fluid outlet 114, a power input shaft 108, a rotor 122, a stator 124, and a coupling rod 126.

The fluid inlet 110 can be arranged on a side of the progressive cavity pump 112. The fluid inlet 110 can receive the fluid to be pumped. The fluid inlet 110 can receive a fluid at a positive pressure (e.g., pre-pressurized), a negative pressure (e.g., suction head), or ambient pressure. The fluid outlet 114 can be arranged on the longitudinal end of the progressive cavity pump 112. The fluid outlet 114 can provide the pumped and/or pressurized fluid from the progressive cavity pump 112.

The rotor 122 can be configured to mesh with the stator 124. The rotor 122 and the stator 124 can be configured to generate a series of propagating cavities when the rotor 122 is rotated within the stator 124. This series of propagating cavities can move fluid from the fluid inlet 110 to the fluid outlet 114. The rotor 122 can include a helical shape (e.g., single helix (e.g., a single high lobe across 360 degrees at a specified cross section of the rotor 122), a double helix (e.g., two high lobes across 360 degrees)), and the stator 124 can include a corresponding helical shape, which can include a helical count that is one greater than the helical count of the rotor (e.g., a single helical rotor and a double helical stator (e.g., two indentations across 360 at a specified cross section of the stator 124), a double helical rotor and a triple helical stator). When the rotor 122 rotates within the stator 124, a center axis of the rotor 122 can move with respect to a center axis of the stator 124.

The coupling rod 126 can be configured to rotationally couple the rotor 122 to the power input shaft 108. The coupling rod 126 can be configured to accommodate an offset (e.g., a lateral offset in two parallel axes, an angular offset between two noncollinear axes) between an axis of the rotor 122 and an axis of the power input shaft 108. This can allow the axis of the power input shaft 108 to remain stationary with respect to an axis of the stator 124 while an axis of the rotor 122 moves with respect to an axis of the stator 124. The coupling rod 126 can include non-collinear couplings on one or both ends, which can allow the coupling rod 126 to be non-collinear with one or more of the rotor 122 or the power input shaft 108.

The housing 116 can be configured to be mounted to the prime mover 130, the progressive cavity pump 112, or both. The housing 116 may connect the prime mover 130 to the progressive cavity pump 112. The housing 116 can be a substantially rigid frame, which can result in the housing 116 holding the prime mover 130 and the progressive cavity pump 112 in a substantially consistent orientation and/or relative longitudinal position. The prime mover shaft 106 can extend partially into (e.g., through) the housing 116. The power input shaft 108 can extend partially into the housing 116.

The shaft coupling 120 can be configured for coupling the prime mover shaft 106 to the power input shaft 108. The shaft coupling 120 can be positioned within the housing 116. The shaft coupling 120 can be positioned between the progressive cavity pump 112 and the prime mover 130.

The seal assembly 140 can be configured to seal around the power input shaft 108, such as to prevent or limit a fluid from escaping from the progressive cavity pump 112. The power input shaft 108 can pass from a region that is exposed to ambient conditions to a region that is exposed to conditions similar to the fluid inlet 110 (e.g., the conditions of the intake chamber 430, discussed below). For example, the power input shaft may pass from outside the intake chamber and into the intake chamber. The seal assembly 140 may be provided at the transition from outside to inside to prevent or limit the escape of fluid from the chamber.

Figure 4:
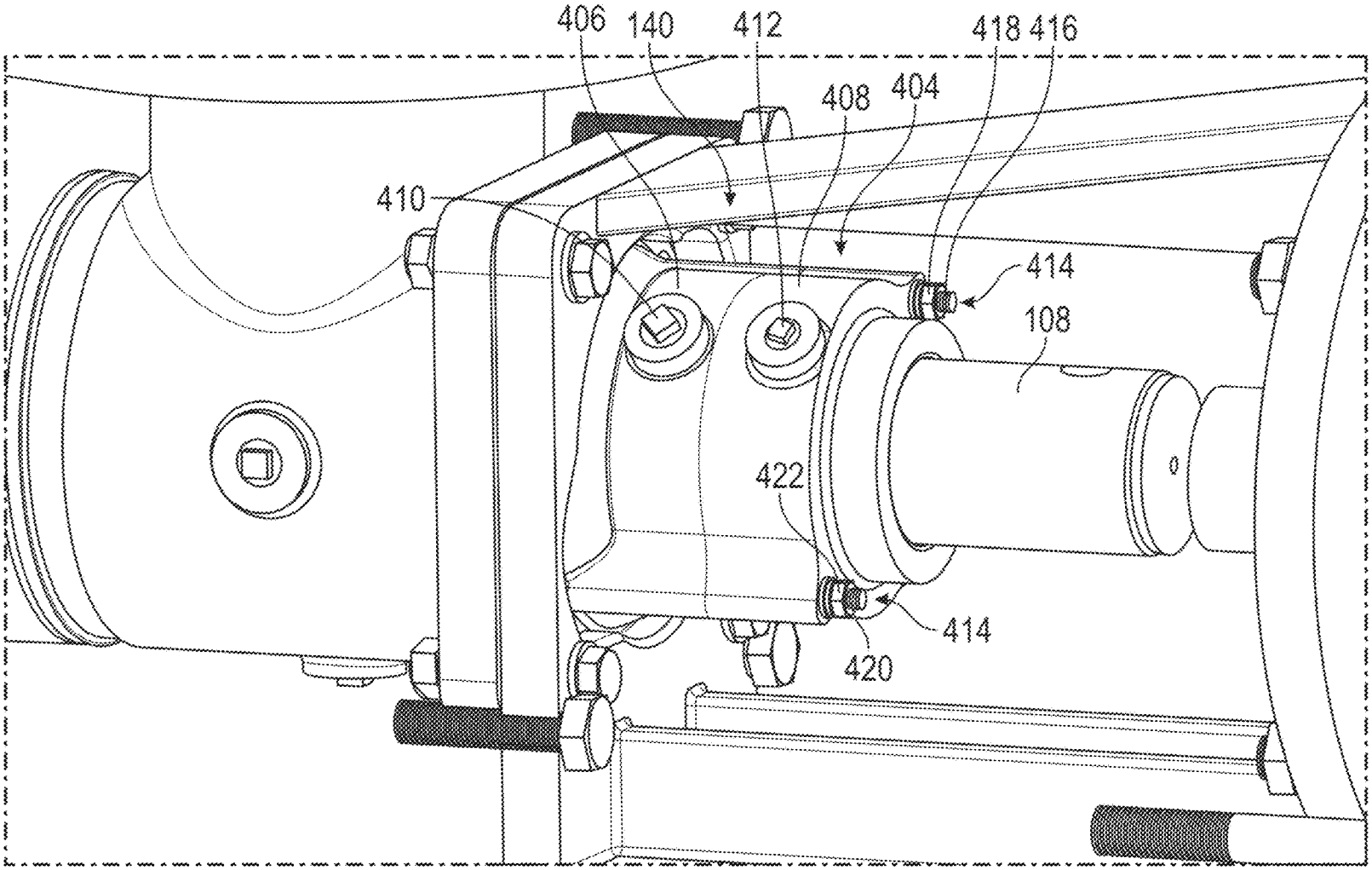
FIG. 4 shows a close-up perspective view of the seal assembly of the progressive cavity pump system of FIG. 1.
Figure 5:
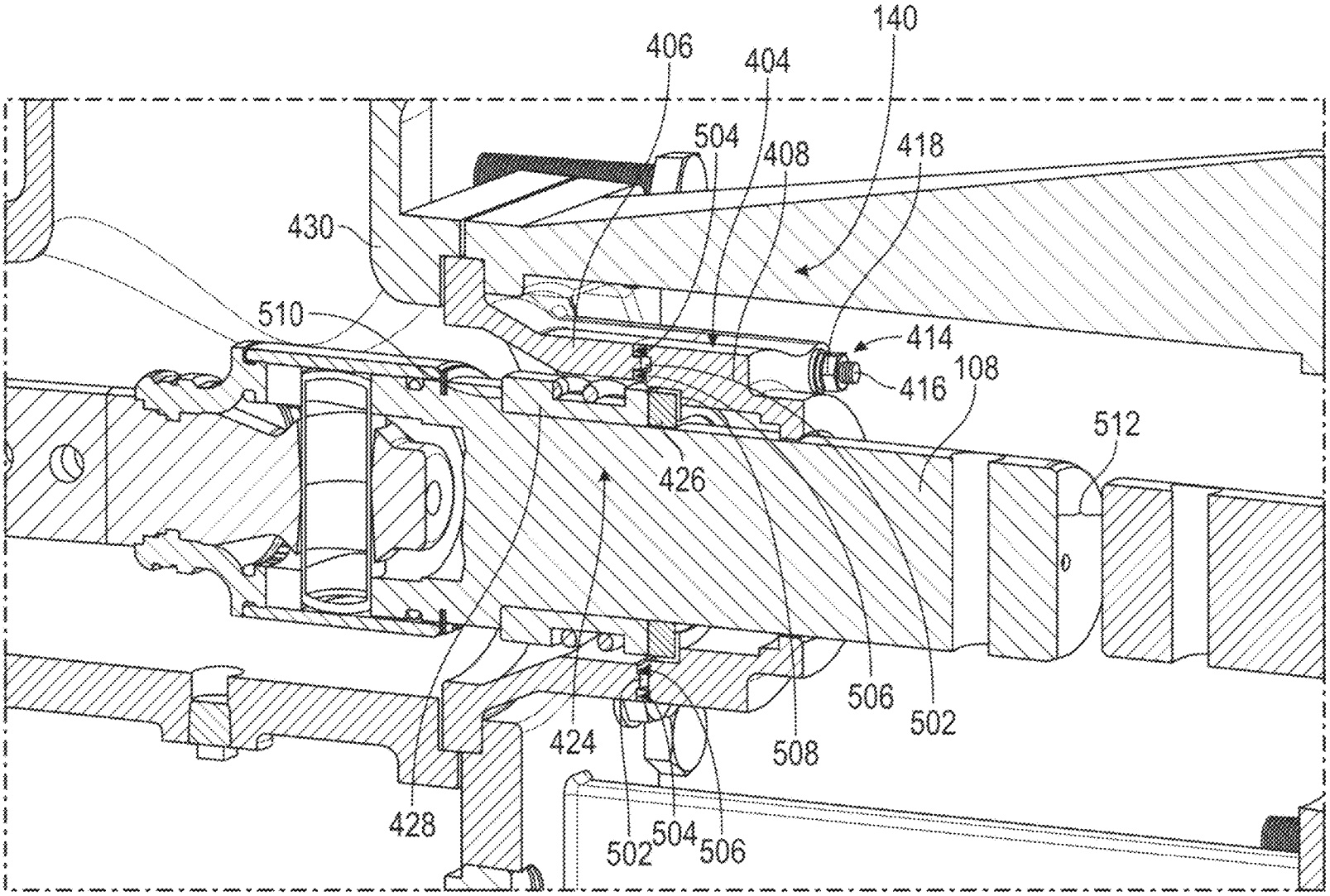
FIG. 5 shows a close-up cross-sectional view of the seal assembly of the progressive cavity pump system of FIG. 1.
Figure 6:
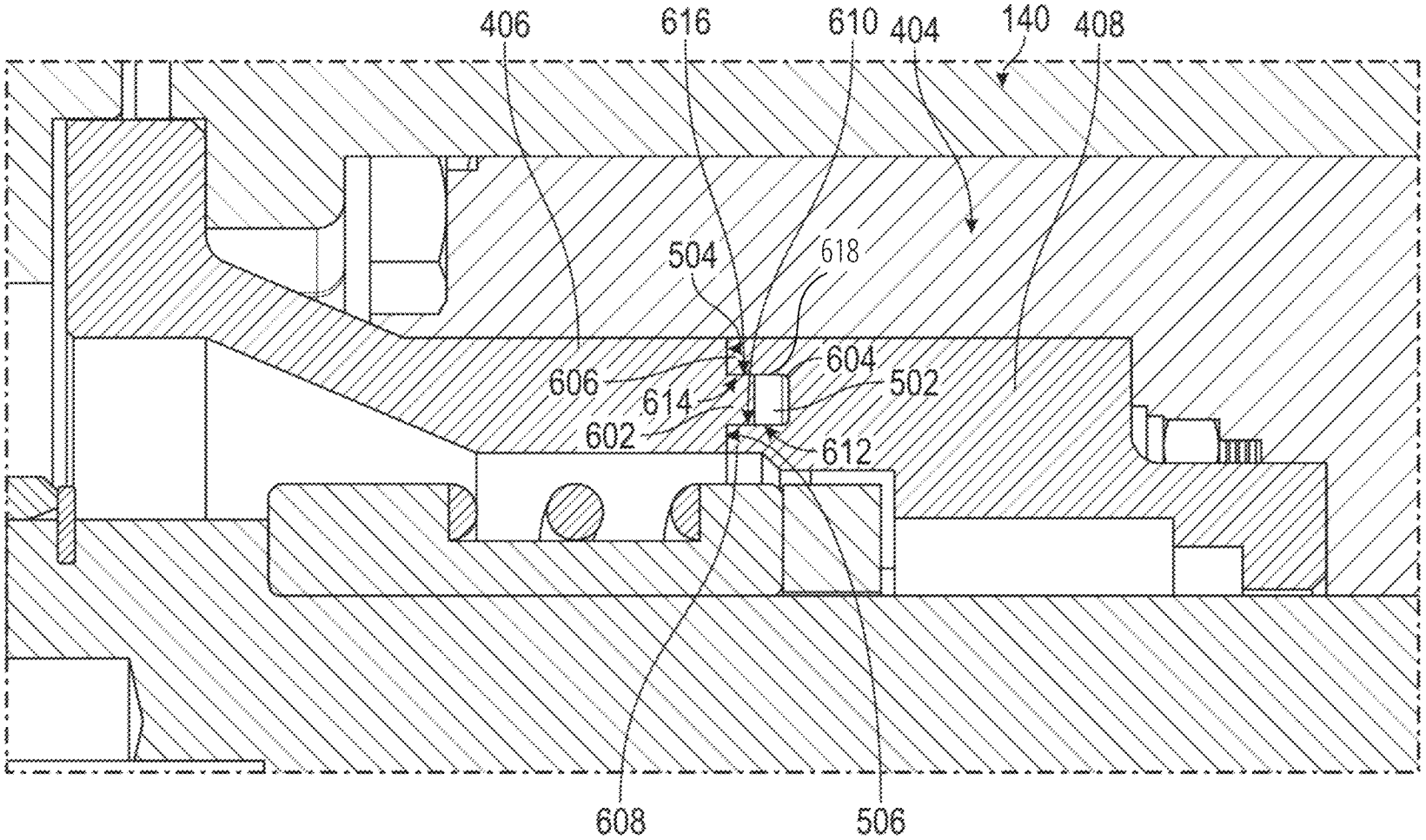
FIG. 6 shows a close up cross-sectional view of the seal assembly of FIG. 5.

FIG. 4 shows a closer view of the progressive cavity pump system 100 of FIG. 1, which is focused on the seal assembly 140. FIG. 4 shows a perspective view of an example of portions of a seal assembly 140 looking from the direction of prime mover 130 towards the progressive cavity pump 112. FIG. 5 shows a cross sectional view of the progressive cavity pump system 100 also focused on the seal assembly and with a perspective similar to FIG. 4. FIG. 6 shows a cross sectional view of a seal assembly 140, including portions of a progressive cavity pump system 100, which is focused on the upper portion of the seal assembly 140. FIG. 4 through FIG. 6 will be discussed together below.

The seal assembly 140 can be configured for sealing a power input shaft 108 of a progressive cavity pump 112. The seal assembly 140 can include a seal housing 404, which can include a mounted portion 406 and a removable portion 408, and an attachment system 414.

The seal housing 404 can be arranged around the power input shaft 108. The seal housing 404 can be configured for one or more of mounting a portion of the seal assembly 140 (e.g., mounting the seal assembly 140 to the progressive cavity pump 112), containing a fluid within the seal housing 404, applying a compression force to the seal 424, or holding the static portion 426 of the seal 424. The seal housing 404 can include the mounted portion 406 and the removable portion 408.

The mounted portion 406 can be mounted to the progressive cavity pump. The mounted portion 406 can be configured to attach the seal housing 404 to the progressive cavity pump 112, receive the removable portion 408, or both. The mounted portion 406 can be a generally cylindrical element. The mounted portion 406 can have a diameter that generally decreases in portions of the removable portion 408 closer to the prime mover 130. The mounted portion 406 can partially enclose or encompass the seal 424. The mounted portion can be mounted to an intake chamber 430 of the progressive cavity pump. For example, the mounted portion may include a flange at one end that extends radially outward and between the housing and a portion of the intake chamber. The flange can be compressed between the housing 116 and the intake chamber 430, such as by the bolts mounting the progressive cavity pump 112 to the housing 116. The mounted portion 406 can include a drain plug 410. The drain plug 410 can be configured to place a region inside the mounted portion 406 in communication with ambient conditions, which can depressurize a chamber within the mounted portion 406, drain a chamber within the mounted portion 406, or both.

The removable portion 408 can be removably coupled to the mounted portion. The removable portion 408 can be configured to apply a compression force to a seal 424 within the seal assembly 140 (e.g., bear on the static portion 426, which can apply a compression force to the dynamic portion 428). The removable portion 408 can be a generally cub shaped element, and can include an aperture on the smaller diameter longitudinal end for the power input shaft 108 to pass through. The removable portion 408 can generally surround the power input shaft 108. The removable portion 408 can partially enclose or encompass the seal 424. The removable portion 408 can generally encompass the static portion 426, but might not encompass much or any of the dynamic portion 428. The removable portion 408 can be coupled to the mounted portion 406 using an attachment system 414. The removable portion 408 can include a drain plug 412. The drain plug 412 can be configured to place a region inside the removable portion 408 in communication with ambient conditions, which can depressurize a chamber within the removable portion 408, drain a chamber within the removable portion 408, or both.

The seal assembly 140 can include a sealing element 502. The sealing element 502 can be configured to seal an interface between the mounted portion 406 and the removable portion 408. The sealing element 502 can include a flexible and/or compressible material, such as a rubber or other elastomer. The sealing element 502 can include an O-ring (e.g., a rubber O-ring). The interface can extend circumferentially around the intersection of the mounted portion 406 and the removable portion 408. The sealing element 502 can be positioned between a face of the mounted portion 406 that faces the prime mover 130 and a face of the removable portion 408 that faces away from the prime mover 130. The sealing element 502 can be positioned between the end face of the cylindric shape of the mounted portion 406 facing the prime mover 130 and the end face of the cup shape of the removable portion 408 facing away from the prime mover 130.

The mounted portion 406, the removable portion 408, or both can be configured so that a portion of the mounted portion 406 is in direct contact with a portion of the removable portion 408. The portion of the mounted portion 406 that is in direct contact with the removable portion 408 can extend circumferentially along the entire circumference of the interface, or can extend only partially along the interface. In an example, there can be any number of portions in direct contact (e.g., three portions, which can be spaced apart by approximately 120 degrees). The direct contact can include a first direct contact interface 504 and a second direct contact interface 506.

Being in direct contact can include a material in the mounted portion 406 touching a portion of the material in the removable portion 408, such as can include touching without any intervening components. In an example, being in direct contact can include a substantially incompressible intervening component between the mounted portion 406 and the removable portion 408, which can include a metal spacer or washer.

The first direct contact interface 504 can extend circumferentially around the interface between the mounted portion 406 and the removable portion 408, which can include extending around the full perimeter of the interface.

The second direct contact interface 506 can extend circumferentially around the interface between the mounted portion 406 and the removable portion 408, which can include extending around the full perimeter of the interface.

The seal assembly 140 can include a first radial alignment feature on the mounted portion 406 and a second radial alignment feature on the removable portion 408. The first radial alignment feature can correspond to the second radial alignment feature (e.g., can be configured to interface with). The radial alignment features can be configured to help to radially align (e.g., align center axes, which can include aligning the angles of center axes, aligning the center axes to intersect, or both) the removable portion 408 with the mounted portion 406.

That is, and with reference to FIG. 6, one of the first radial alignment feature or the second radial alignment feature can include a radially outward facing surface. Another one of the first radial alignment feature or the second radial alignment feature can include a radially inward facing surface. The radially inward facing surface can be configured to bear on the radially outward facing surface, which can help to radially align the removable portion 408 with the mounted portion 406.

The removable portion 408 can include a first radially outward facing surface 612 and a second radially inward facing surface 616. The mounted portion 406 can include a first radially inward facing surface 610 and a second radially outward facing surface 614. The first radially inward facing surface 610 can be configured to bear on the first radially outward facing surface 612. The second radially inward facing surface 616 can be configured to bear on the second radially outward facing surface 614.

The first radially inward facing surface 610 and the second radially outward facing surface 614 can be included on a raised lip 602. The raised lip 602 can extend circumferentially along the edge of the removable portion 408 facing away from the prime mover 130. The first radially outward facing surface 612 and the second radially inward facing surface 616 can be included in a channel 604. The channel 604 can extend circumferentially along the edge of the mounted portion 406 facing the prime mover 130. The channel 604 can include a second channel wall 608 and a first channel wall 606. The first radially outward facing surface 612 can be included on the second channel wall 608. The second radially inward facing surface 616 can be included in the first channel wall 606.

The first direct contact interface 504 and the second direct contact interface 506 can be on opposite sides of the channel 604 (e.g., on opposite sides of the raised lip 602). The mounted portion 406 and the removable portion 408 can be in direct contact on both sides of the channel 604.

The direct contact (e.g., the first direct contact interface 504 and the second direct contact interface 506) between the mounted portion 406 and the removable portion 408 can control (e.g., provide) a longitudinal position (e.g., the spacing between the mounted portion 406 and the removable portion 408, which can affect a compression on the seal 424). and/or an angular axial alignment (e.g., making a center axis of the mounted portion 406 parallel to and/or coincident with a center axis of the removable portion 408) of the removable portion 408 to the mounted portion 406.

The sealing element 502 can include a portion, such as an O-ring, positioned in the channel 604. The portion within the raised lip 602 can be compressed between the channel 604 and the raised lip 602, which can help to provide a seal between the mounted portion 406 and the removable portion 408. The direct contact (e.g., the first direct contact interface 504, the second direct contact interface 506, or both) between the mounted portion 406 and the removable portion 408 can control the compression of the sealing element. For example, the depth of the channel 604, the height of the raised lip 602, or both, can be configured to provide a particular longitudinal width of a seal gap 618. This seal gap 618 may be sized in conjunction with the thickness or cross-sectional diameter of the sealing element 502 to provide a particular amount of compression on the sealing element 502 when the sealing element is arranged in the seal gap 618 and the raised lip 602 is fully seated within the channel 604.

The attachment system 414 can be configured to one or more of removably couple the removable portion 408 to the mounted portion 406, apply a compression force between the mounted portion 406 and removable portion 408, or apply a compression force to the seal 424. The attachment system 414 can include any system capable of attaching components or applying a compression force. In an example, the attachment system 414 can include one or more fasteners. The fasteners can include one or more of bolts, nuts, screws (e.g., machine screws, carriage bolts, lag bolts), clamps (e.g., hose clamps) U-bolts, or any other type of fastener or fastener component. In an example, one or more of the fasteners can include a stud, which can be attached to the mounted portion 406, and a nut, which can thread onto the stud and apply a force to the removable portion 408.

In the example of FIG. 4, the attachment system 414 can include two fasteners. The first fastener can include a first stud 416 and a first nut 418. The second fastener can include a second stud 420 and a second nut 422. One or more of the first stud 416 or the second stud 420 can be attached to the mounted portion 406. The first nut 418 can thread onto the first stud 416, and can apply a force to the removable portion 408. The second nut 422 can thread onto the second stud 420, and can apply a force to the removable portion 408. That is, studs may extend from the mounted portion through sleeves in the removable portion and the nuts can thread onto respective studs and draw the removable portion toward the mounted portion. Washers including lock washers, or other devices to resist or prevent loosening of the connection may also be provided. Moreover, while a stud and nut system has been described, alternatively or additionally, the mounted portion may have threaded bores and bolts may be extend through sleeves in the removable portion and engage the threaded bores on the mounted portion. The bolts may be tightened to draw the removable portion toward the mounted portion. Still other fastener approaches may be used.

The seal 424 can be configured to prevent a material within the intake chamber 430 from flowing out of the intake chamber 430 along the power input shaft 108. The seal 424 can include a dynamic portion 428 and a static portion 426. The static portion 426 can remain substantially stationary relative to the seal assembly 140 as the power input shaft 108 rotates. The static portion 426 can press against a shoulder 508 on the removable portion 408. The dynamic portion 428 can include a dynamic sealing face that rides on a static sealing face of the static portion 426.

The dynamic portion 428 can remain substantially stationary relative to the power input shaft 108 as the power input shaft 108 rotates. The dynamic portion 428 can press against a shoulder 510 on the power input shaft 108. The dynamic portion 428 can include a dynamic sealing face. The dynamic portion 428 can include a mechanical seal, such as a single spring mechanical seal.

The removable portion 408 can be configured to interface with the static portion 426 of the seal 424 and can be configured to apply a compression force to the dynamic portion 428 (e.g., the single spring mechanical seal) through the stationary static portion 426. As such, the relative position of the removable portion and the shoulder 510 on the power input shaft 108 can function to determine an amount of compression that is provided for the seal 424. Moreover, the direct contact between the mounted portion 406 and the removable portion 408 can be helpful to maintain a proper position of the removable portion 408 relative to the intake chamber 430 and the housing 116 such that a proper relative position of the removable portion 408 and the power input shaft 108 is maintained. This may provide for a particular amount of compression force, compressed dimensions, or both, on the dynamic portion 428 and may increase the likelihood that these particular amounts of compression or compressed dimensions are achieved and/or maintained.

In an example, one or more of the dynamic portion 428 or the static portion 426 can include a removeable component including a sealing face. For example, the static sealing face or the dynamic sealing face can be included on a removeable component. In an example, the static portion 426 comprises a removeable component including a sealing face. There can be a gap 512 between the prime mover shaft 106 and the power input shaft 108 that has a length in a longitudinal direction that is greater than a width of the component including the removeable component including the sealing face. This can allow the removeable component with the sealing face to be moved longitudinally along the power input shaft 108 until it reaches the gap 512 and then passed laterally through the gap 512, such as while the prime mover 130 and the progressive cavity pump 112 remain mounted to the housing 116. For example, the shaft coupling 120 can be removed, the removable portion 408 can be decoupled from the mounted portion 406 and slid off the power input shaft 108 onto the prime mover shaft 106, and the static portion 426 can be slid along the power input shaft 108 to the gap and may be removed laterally through the gap to allow for replacement. The new static portion may be installed in the opposite manner (e.g., introduced laterally through the gap, and slid along the power input shaft to engage the dynamic portion 428.)

Figure 7:
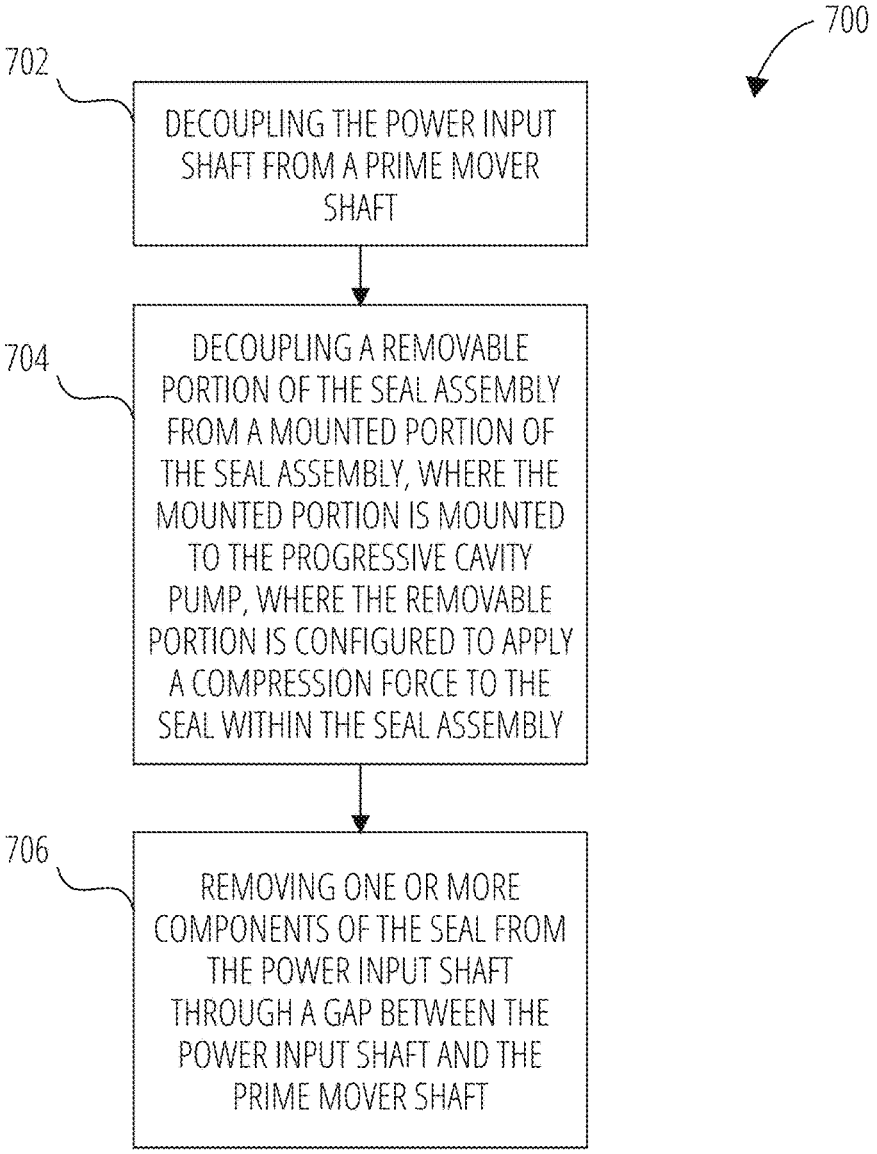
FIG. 7 shows a diagram depicting a method of replacing a seal component.

FIG. 7 shows an example of portions of a method 700 for replacing a seal (e.g., a portion or all of the seal 424, such as a component including a sealing face) in a seal assembly (e.g., the seal assembly 140) for sealing a power input shaft (e.g., the power input shaft 108) of a progressive cavity pump (e.g., the progressive cavity pump 112). The method 700 can be performed on the progressive cavity pump system 100. At step 702, the power input shaft can be decoupled from a prime mover shaft (e.g., the prime mover shaft 106). This can include removing a coupling (e.g., the shaft coupling 120) that is coupling the prime mover shaft to the power input shaft.

At step 704, a removable portion (e.g., the removable portion 408) of the seal assembly can be decoupled from a mounted portion (e.g., the mounted portion 406) of the seal assembly. The mounted portion can be mounted to the progressive cavity pump. The removable portion can be configured to apply a compression force to the seal within the seal assembly. The method 700 can include loosening an attachment system (e.g., the attachment system 414, which can include removing the first nut 418 and the second nut 422), which can allow the removable portion to be removed from the mounted portion.

At step 706 one or more components of the seal can be removed from the power input shaft through a gap (e.g., the gap 512) between the power input shaft and the prime mover shaft. This can include removing one or more of one or more components including sealing faces, the static portion 426, or the dynamic portion 428.

The method 700 can include sliding the removable portion off of the power input shaft and onto the prime mover shaft, such as following step 704. For example a collar on the removable portion that is proximate the power input shaft may be slid passed the gap onto the prime mover shaft. That is, in one or more examples, the removable portion might not be slid fully onto the prime mover shaft and, instead, only a portion sufficient to allow for the component including a sealing face to reach the gap may be slid onto the prime mover shaft.

The method 700 can include installing one or more components of the seal onto the power input shaft through the gap between the power input shaft and the prime mover shaft. For example, the components that are removed can be reinstalled (e.g., after cleaning or reconditioning) or replaced (e.g., replaced with new components). The removable portion can be coupled to the mounted portion, such as following installing one or more components. The power input shaft can be coupled to the prime mover shaft, such as following installing one or more components.

In an example, one or more (e.g., all) of the steps of the method 700 can be performed while leaving the prime mover coupled to the progressive cavity pump. This can include removing the one or more seal components while leaving the prime mover coupled to the progressive cavity pump.

The shown order of steps is not intended to be a limitation on the order in which the steps are performed. In an example, two or more steps may be performed simultaneously or at least partially concurrently.

The following, non-limiting examples, detail certain aspects of the present subject matter to solve the challenges and provide the benefits discussed herein, among others.

EXAMPLES

Example 1 is a seal assembly for sealing a power input shaft of a progressive cavity pump, the seal assembly comprising: a seal housing arranged around the power input shaft, the seal housing including: a mounted portion, mounted to the progressive cavity pump; a removable portion, removably coupled to the mounted portion, configured to apply a compression force to a seal within the seal assembly; and a sealing element, configured to seal an interface between the mounted portion and the removable portion; wherein the seal housing is configured so that a portion of the mounted portion is in direct contact with a portion of the removable portion.

In Example 2, the subject matter of Example 1 optionally includes a first radial alignment feature on the mounted portion; and a second radial alignment feature on the removable portion, wherein the first radial alignment feature corresponds to the second radial alignment feature, wherein the radial alignment features are configured to radially align the removable portion with the mounted portion.

In Example 3, the subject matter of Example 2 optionally includes wherein: one of the first radial alignment feature or the second radial alignment feature includes a radially outward facing surface; an other one of the first radial alignment feature or the second radial alignment feature includes a radially inward facing surface; and the radially inward facing surface is configured to bear on the radially outward facing surface to radially align the removable portion with the mounted portion.

In Example 4, the subject matter of Example 3 optionally includes wherein: the radially outward facing surface is included on a raised lip; and the radially inward facing surface is included on a channel.

In Example 5, the subject matter of Example 4 optionally includes wherein: the mounted portion and the removable portion are in direct contact on both sides of the channel.

In Example 6, the subject matter of Example 5 optionally includes an O-ring, positioned in the channel, wherein the sealing element includes the O-ring.

In Example 7, the subject matter of any one or more of Examples 2-6 optionally include an attachment system, configured to removably couple the removable portion to the mounted portion, wherein the direct contact between the mounted portion and the removable portion controls a longitudinal position and an angular axial alignment of the removable portion to the mounted portion.

In Example 8, the subject matter of any one or more of Examples 1-7 optionally include wherein the direct contact between the mounted portion and the removable portion controls the compression of the sealing element.

In Example 9, the subject matter of any one or more of Examples 1-8 optionally include wherein the mounted portion is mounted to an intake chamber of the progressive cavity pump.

In Example 10, the subject matter of Example 9 optionally includes wherein the seal is configured to prevent a material within the intake chamber from flowing out of the intake chamber along the power input shaft.

In Example 11, the subject matter of any one or more of Examples 9-10 optionally include the seal, wherein the seal includes a single spring mechanical seal.

In Example 12, the subject matter of Example 11 optionally includes wherein the removable portion is configured to interface with a static portion of the seal, wherein the removable portion is configured to apply a compression force to the single spring mechanical seal through the static portion, wherein the direct contact between the mounted portion and the removable portion controls the compression force on the single spring mechanical seal.

Example 13 is a method of replacing one or more components of a seal in a seal assembly for sealing a power input shaft of a progressive cavity pump, the method comprising: decoupling the power input shaft from a prime mover shaft; decoupling a removable portion of the seal assembly from a mounted portion of the seal assembly, wherein the mounted portion is mounted to the progressive cavity pump, wherein the removable portion is configured to apply a compression force to the seal within the seal assembly; and removing one or more components of the seal from the power input shaft through a gap between the power input shaft and the prime mover shaft.

In Example 14, the subject matter of Example 13 optionally includes sliding the removable portion off of the power input shaft and onto the prime mover shaft.

In Example 15, the subject matter of any one or more of Examples 13-14 optionally include installing one or more components of the seal onto the power input shaft through the gap between the power input shaft and the prime mover shaft; coupling the removable portion to the mounted portion; and coupling the power input shaft to the prime mover shaft.

In Example 16, the subject matter of any one or more of Examples 13-15 optionally include leaving a prime mover coupled to the progressive cavity pump while removing the one or more components of the seal.

Example 17 is a progressive cavity pump system, comprising: a prime mover including a prime mover shaft; a progressive cavity pump, including a power input shaft; and a seal assembly for sealing the power input shaft of a progressive cavity pump, the seal assembly comprising: a seal housing arranged around the power input shaft, the seal housing including: a mounted portion, mounted to the progressive cavity pump; a removable portion, removably coupled to the mounted portion, configured to apply a compression force to a seal within the seal assembly; and a sealing element, configured to seal an interface between the mounted portion and the removable portion; wherein the seal housing is configured so that a portion of the mounted portion is in direct contact with a portion of the removable portion.

In Example 18, the subject matter of Example 17 optionally includes wherein: the seal includes a removeable component including a sealing face; and there is a gap between the prime mover shaft and the power input shaft that has a length in a longitudinal direction that is greater than a width of the removeable component including the sealing face.

In Example 19, the subject matter of any one or more of Examples 17-18 optionally include a first radial alignment feature on the mounted portion; and a second radial alignment feature on the removable portion, wherein the first radial alignment feature corresponds to the second radial alignment feature, wherein the radial alignment features are configured to radially align the removable portion with the mounted portion.

In Example 20, the subject matter of any one or more of Examples 17-19 optionally include wherein the direct contact between the mounted portion and the removable portion controls the compression of the sealing element.

Example 21 is at least one machine-readable medium including instructions that, when executed by processing circuitry, cause the processing circuitry to perform operations to implement of any of Examples 1-20.

Example 22 is an apparatus comprising means to implement of any of Examples 1-20.

Example 23 is a system to implement of any of Examples 1-20.

Example 24 is a method to implement of any of Examples 1-20.

Each of the non-limiting aspects above can stand on its own or can be combined in various permutations or combinations with one or more of the other aspects or other subject matter described in this document.

The above detailed description includes references to the accompanying drawings, which form a part of the detailed description. The drawings show, by way of illustration, specific examples that may be practiced. These embodiments are also referred to herein as "examples." Such examples may include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

All publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls.

In this document, the terms "a" or "an" are used, as is common in patent documents, to include one or more than one, independent of any other instances or usages of "at least one" or "one or more." In this document, the terms "or" and "and/or" are used to refer to a nonexclusive or, such that "A or B" includes "A but not B," "B but not A," and "A and B," unless otherwise indicated. In the appended claims, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The term "about," as used herein, means approximately, in the region of, roughly, or around. When the term "about" is used in conjunction with a numerical range, it modifies that range by extending the boundaries above and below the numerical values set forth. In general, the term "about" is used herein to modify a numerical value above and below the stated value by a variance of 10%. In one aspect, the term "about" means plus or minus 10% of the numerical value of the number with which it is being used. Therefore, about 50% means in the range of 45%-55%. Numerical ranges recited herein by endpoints include all numbers and fractions subsumed within that range (e.g., 1 to 5 includes 1, 1.5, 2, 2.75, 3, 3.90, 4, 4.24, and 5). Similarly, numerical ranges recited herein by endpoints include subranges subsumed within that range (e.g., 1 to 5 includes 1-1.5, 1.5-2, 2-2.75, 2.75-3, 3-3.90, 3.90-4, 4-4.24, 4.24-5, 2-5, 3-5, 1-4, and 2-4).

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Such instructions can be read and executed by one or more processors to enable performance of operations comprising a method, for example. The instructions are in any suitable form, such as but not limited to source code, compiled code, interpreted code, executable code, static code, dynamic code, and the like.

Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other examples may be used, such as by one of ordinary skill in the art upon reviewing the above description. The Abstract is to allow the reader to quickly ascertain the nature of the technical disclosure and is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment. The scope of the examples should be determined with reference to the appended claims, along with the full scope of equivalents to which such claims are entitled.

What is claimed is:

1. A seal assembly for sealing a power input shaft of a progressive cavity pump, the seal assembly comprising:

a seal housing arranged around the power input shaft, the seal housing including:

a mounted portion, mounted to the progressive cavity pump;

a removable portion, removably coupled to the mounted portion, configured to apply a compression force to a seal within the seal assembly; and a sealing element, configured to seal an interface between the mounted portion and the removable portion;

wherein:

the seal housing is configured so that a portion of the mounted portion is in direct contact with a portion of the removable portion; and one of the mounted portion or the removable portion includes a raised lip; and the other one of the mounted portion and the removable portion includes a channel, configured to interface with the raised lip.

2. The seal assembly of claim 1, comprising:

a first radial alignment feature on the mounted portion; and a second radial alignment feature on the removable portion, wherein the first radial alignment feature corresponds to the second radial alignment feature, wherein the radial alignment features are configured to radially align the removable portion with the mounted portion.

3. The seal assembly of claim 2, wherein:

one of the first radial alignment feature or the second radial alignment feature includes a radially outward facing surface;

an other one of the first radial alignment feature or the second radial alignment feature includes a radially inward facing surface; and the radially inward facing surface is configured to bear on the radially outward facing surface to radially align the removable portion with the mounted portion.

4. The seal assembly of claim 3, wherein:

the radially outward facing surface is included on the raised lip; and the radially inward facing surface is included on the channel.

5. The seal assembly of claim 4, wherein:

the mounted portion and the removable portion are in direct contact on both sides of the channel.

6. The seal assembly of claim 5, comprising:

an O-ring, positioned in the channel, wherein the sealing element includes the O-ring.

7. The seal assembly of claim 2, comprising:

an attachment system, configured to removably couple the removable portion to the mounted portion, wherein the direct contact between the mounted portion and the removable portion controls a longitudinal position and an angular axial alignment of the removable portion to the mounted portion.

8. The seal assembly of claim 1, wherein the direct contact between the mounted portion and the removable portion controls the compression of the sealing element.

9. The seal assembly of claim 1, wherein the mounted portion is mounted to an intake chamber of the progressive cavity pump.

10. The seal assembly of claim 9, wherein the seal is configured to prevent a material within the intake chamber from flowing out of the intake chamber along the power input shaft.

11. The seal assembly of claim 9, further comprising the seal within the seal assembly, wherein the seal within the seal assembly includes a single spring mechanical seal.

12. The seal assembly of claim 11, wherein the removable portion is configured to interface with a static portion of the seal, wherein the removable portion is configured to apply a compression force to the single spring mechanical seal through the static portion, wherein the direct contact between the mounted portion and the removable portion controls the compression force on the single spring mechanical seal.

13. A method of replacing one or more components of a seal in a seal assembly for sealing a power input shaft of a progressive cavity pump, the method comprising:

decoupling the power input shaft from a prime mover shaft;

decoupling a removable portion of the seal assembly from a mounted portion of the seal assembly, wherein the mounted portion is mounted to the progressive cavity pump, wherein the removable portion is configured to apply a compression force to the seal within the seal assembly; and removing one or more components of the seal from the power input shaft through a gap between the power input shaft and the prime mover shaft, wherein the gap between the power input shaft and the prime mover shaft exists when the progressive cavity pump is in a fully assembled condition.

14. The method of claim 13, comprising:

sliding the removable portion off of the power input shaft and onto the prime mover shaft.

15. The method of claim 13, comprising:

installing one or more components of the seal onto the power input shaft through the gap between the power input shaft and the prime mover shaft;

coupling the removable portion to the mounted portion; and coupling the power input shaft to the prime mover shaft.

16. The method of claim 13, comprising;

leaving a prime mover coupled to the progressive cavity pump while removing the one or more components of the seal.

17. A progressive cavity pump system, comprising:

a prime mover including a prime mover shaft;

a progressive cavity pump, including a power input shaft; and a seal assembly for sealing the power input shaft of a progressive cavity pump, the seal assembly comprising:

a seal housing arranged around the power input shaft, the seal housing including:

a mounted portion, mounted to the progressive cavity pump;

a removable portion, removably coupled to the mounted portion, configured to apply a compression force to a seal within the seal assembly; and a scaling element, configured to seal an interface between the mounted portion and the removable portion;

wherein:

the seal housing is configured so that a portion of the mounted portion is in direct contact with a portion of the removable portion;

the seal within the seal assembly includes a removable component including a sealing face; and there is a gap between the prime mover shaft and the power input shaft that has a length in a longitudinal direction that is greater than a width of the removable component including the sealing face.

18. The progressive cavity pump system of claim 17, comprising:

a first radial alignment feature on the mounted portion; and a second radial alignment feature on the removable portion, wherein the first radial alignment feature corresponds to the second radial alignment feature, wherein the radial alignment features are configured to radially align the removable portion with the mounted portion.

19. The progressive cavity pump system of claim 17, wherein the direct contact between the mounted portion and the removable portion controls the compression of the sealing element.

* * * * *